US005219647A

United States Patent [19]

Vock et al.

[11] Patent Number: 5,219,647

[45] Date of Patent: Jun. 15, 1993

[54] THERMALLY STABLE, BINDER-CONSOLIDATED SPUNBONDED WEB

[75] Inventors: Günther Vock, Bobingen; Michael Schöps, Grossaitingen, both of Fed. Rep. of Germany

[73] Assignee: Hoechst Aktiengesellschaft, Fed. Rep. of Germany

[21] Appl. No.: 680,988

[22] Filed: Apr. 5, 1991

[30] Foreign Application Priority Data

Apr. 9, 1990 [DE] Fed. Rep. of Germany ..... 4011479

[51] Int. Cl.[5] ..... D04H 1/58

[52] U.S. Cl. ..... 428/288; 156/180; 156/181; 156/308.2; 428/224; 428/244; 428/283; 428/284; 428/287; 428/296; 428/297; 428/373; 428/920

[58] Field of Search ..... 428/288, 296, 297, 350, 428/224, 283, 244, 284, 373, 920, 287; 156/180, 181, 308.2

[56] References Cited

U.S. PATENT DOCUMENTS

| | | | |
|---|---|---|---|
| 3,117,056 | 1/1964 | Katz et al. | 161/170 |
| 3,975,224 | 8/1976 | Ruzek et al. | 156/167 |
| 4,129,675 | 12/1978 | Scott | 428/296 |
| 4,210,690 | 7/1980 | Hartmann et al. | 428/296 |
| 4,310,594 | 1/1982 | Yamazaki et al. | 428/296 |
| 4,722,857 | 2/1988 | Tomioka et al. | 428/296 |
| 4,842,915 | 6/1989 | Hartmann et al. | 428/296 |
| 4,861,633 | 8/1989 | Abe | 428/296 |

FOREIGN PATENT DOCUMENTS

| | | |
|---|---|---|
| 2240437 | 1/1976 | Fed. Rep. of Germany . |
| 1435114 | 11/1978 | Fed. Rep. of Germany . |
| 3642089 | 6/1988 | Fed. Rep. of Germany . |

*Primary Examiner*—James J. Bell
*Attorney, Agent, or Firm*—Connolly & Hutz

[57] ABSTRACT

There is described a thermally stable, binder-consolidated spunbonded web formed from load-carrying filaments and binder filaments where the melting point of the binder filaments is less than 30° C below that of the load-carrying filaments.

The binder and the load-carrying filaments are preferably made of polyesters. The basis weight of the spunbonded web is within the range between 50 and 500 g/m$^2$, the denier of the load-carrying and the binder filaments is within the range between 1 and 20 dtex, and the proportion of binder filament is between 5 and 25 percent by weight. The web has a particularly high thermal resistance, i.e. a particularly high resistance to high downstream processing temperatures. It is usable for example as a support material for roofing membranes and as a tufting support and so on.

18 Claims, No Drawings

THERMALLY STABLE, BINDER-CONSOLIDATED SPUNBONDED WEB

The invention relates to a thermally stable binderconsolidated spunbonded web formed from load-carrying filaments and binder filaments where the difference between the melting points of the load-carrying filaments and the binder filaments is less than 30° C.

DE-C-14 35 114 discloses a bonded fiber web which contains crimped fibers or filaments and has been thermally consolidated by means of a thermoplastic binder in powder or fiber form. The melting point of the binder fibers should be at least 20° C. below the melting point of the load-carrying filaments. Owing to the presence of crimped fibers in this bonded fiber web, it is very readily drapable; that it, it falls into folds like a woven cloth. But it cannot be used as a high-strength dimensionally stable reinforcing tow or as a tufting support.

High-strength binder-consolidated spunbonded webs are known for example from DE-C-22 40 437 and DE-A-36 42 089. These prior art spunbondeds, where both the load-carrying filaments and the binder filaments can be made of polyesters, are useful in particular as reinforcing and support materials in needle felt and tufted manufacture. The spunbonded web of DE-C-22 40 437 is based on relatively coarse filaments of more than 8 dtex. The proportion of binder filaments is 10–30%, preferably between 15 and 25%. As regards the spunbonded web described in DE-A-36 42 089 filament deniers of 5 dtex and 12 dtex are reported in the Examples; the proportion of binder filaments is between 10 and 50%, preferably between 15 and 30%. The basis weight is reported to be greater than 120 g/m$^2$.

It is emphasized in said DE-C-22 40 437 that the difference in the melting points of the load-carrying filaments and the binder filaments should be relatively large at not less than 30° C. This is to rule out any thermal damage to the load-carrying filaments in the course of the consolidation of the fiber web. This piece of advice is reinforced in a later publication, DE-A-36 42 089: there the difference between the melting points of the load-carrying filaments and the binder filaments is supposed to be not less than 90° C. For this reason the binder filaments preferred there are polyolefin filaments.

These known binder-consolidated fiber webs have the serious disadvantage that they are not suitable for those purposes where they are exposed to high processing temperatures, since the low melting point of the binder component also appreciably reduces the downstream processing and end-use temperatures.

The present invention then relates to a binder-consolidated fiber web of high strength and dimensional stability which is high temperature resistant, i.e. which has an exceedingly advantageous high downstream processing and end-use temperature.

The binder-consolidated spunbonded web of the present invention comprises load-carrying filaments and fusible binder filaments, the melting point of the binder filaments being less than 30° C., preferably less than 20° C., below the melting point of the load-carrying filaments. The load-carrying filaments and the binder filaments are preferably made of polyester. The basis weight of the spunbonded webs according to the present invention is in general within the range between 50 and 500 g/m$^2$, preferably between 50 and 250 g/m$^2$, but for specific applications may of course also be higher or lower. The deniers of the load-carrying filaments and the binder filaments are preferably within the range between 1 and 20 dtex and the proportion of binder filament is preferably between 5 and 25 percent by weight.

Preference is given to spunbonded webs of the present invention in which the denier of the binder filaments is less than that of the load-carrying filaments.

Preference is given in particular also to those spunbonded webs of the present invention in which the melting point of the binder filaments is from 10 to 20° C. below the melting point of the load-carrying filaments.

In a further preferred embodiment of the spunbonded webs of the present invention, the load-carrying filaments are made of polyethylene terephthalate, while the fusible binder filaments are made of a polymer whose melting point differs by the abovementioned amount from the melting point of the load-carrying filaments. Preferably, the binder filaments are made of a polyester which has been modified with isophthalic acid and which accordingly has a slightly lowered melting point.

The proportion of the total weight of the spunbonded web according to the present invention accounted for by binder filaments is made as small as possible within the abovementioned range and adapted to the intended use of the web. Lower binder contents improve the thermal and mechanical properties still further, while higher binder contents give webs which are particularly resistant to delamination.

The basis weight of the webs according to the present invention and the filament deniers are each chosen within the abovementioned ranges according to the intended use. For example, a tufting support would advantageously have a basis weight of up to 500 g/m$^2$ and a filament denier of up to 20 dtex.

It has proven particularly advantageous to adapt the method of introducing the binder filaments and their proportion to the selected basis weight.

Furthermore, preference is given to those spunbonded webs according to the present invention in which the load-carrying filaments and the binder filaments are made of flame-resistant polyesters.

A further preferred embodiment of webs of the present invention has a layer structure of load-carrying filaments and binder filaments, which is particularly advantageous when the two outer layers do not contain any binder filaments.

For specific applications where a very high electrical conductivity of the bonded fiber webs is important, preference is given to spunbonded webs of the present invention whose binder filaments contain an antistat, in particular carbon black.

A further specific embodiment of the webs according to the present invention contains no separate binder filaments but bicomponent filaments in a core-sheath or side-by-side arrangement composed of the two polymers for the load-carrying and the binder filaments in the desired quantitative ratio.

The spunbonded web formed according to the present invention is free of resinous binders and therefore is inherently of low flammability. As mentioned, the low flammability can be improved still further through the right choice of flame-resistant raw materials for the load-carrying filaments and the binder filaments. These flame-resistant spunbonded webs can then also be used in rooms at risk from fires, for example as support materials for curtains, wallpapers or window blinds or as components of seat covers in motor vehicles or aircraft.

Preference is also given to particularly lofty spunbonded webs according to the present invention as obtained for example using a relatively small proportion of binder filaments and perforated drum fixation. Such webs then also have a looser, fibrous surface structure which distinctly increases the adhesion of coating materials, for example PVC or bitumen. Such lofty spunbonded webs with a high-fiber surface are also suitable for manufacturing filter materials. The addition of antistats—carbon black in the simplest case—in the melt cylinder, moreover, makes it possible to use the spunbonded web formed according to the present invention in explosion hazard zones or else as a filter medium for clean rooms.

The dyeability of the fusible binder can be adapted to that of the load-carrying filaments by modifying the fusible binder raw material; on the other hand, a difference in dyeability may also be exploited for interesting color effects.

The spunbonded web according to the present invention is produced in a conventional manner by deposition of load-carrying and binder filaments on a moving perforated surface to form a random web, the novel process comprising the step of depositing binder filaments whose melting point is less than 30° C., preferably less than 20° C., below the melting point of the load-carrying filaments.

Preference is given to the depositing of load-carrying and binder filaments which are made of polyester. Preference is further given to choosing the deniers of the load-carrying filaments and the binder filaments within the range between 1 and 20 dtex and/or the proportion of binder filament within the range between 5 and 25 percent by weight. The weight of filament deposited per $m^2$ is determined according to the above-specified criteria: in general from 50 to 500 g of filament are deposited per $m^2$.

Preferably, the filaments are deposited using a rotating impingement plate and a downstream guide surface as described in DE-C-27 13 241.

To produce spunbonded webs according to the present invention with the preferred layer structure, the filaments are deposited from a plurality of successive—viewed in the direction of movement of the perforated surface—rows of depositor elements from which load-carrying and binder filaments are deposited alternately. In a specific embodiment, the polymers for the load-carrying filaments and the binder filaments are spun and deposited in the stated weight ratio as bicomponent filaments.

Usually, no needling of the laid filaments is necessary, only a thermal preconsolidation, as described for example in DE-C-33 22 936, followed by a final thermal consolidation, for example with a smooth or an embossed roll. At high basis weights, however, needling may lead to a further improvement in the web properties.

Thermal consolidation is effected particularly preferably with hot air, for example in perforated drum fixation elements, which may be followed by a pair of embossed rolls.

Particularly lofty spunbonded webs are obtained with a minimum proportion of binder filament and perforated drum fixation.

We claim:

1. A binder-consolidated spunbonded web formed from load-carrying polyester filaments and binder polyester filaments, wherein the melting point of the binder filaments is less than 30° C. below the melting point of the load-carrying filaments.

2. The spunbonded web of claim 1, having a basis weight within the range between 50 and 500 g/$m^2$.

3. The spunbonded web of claim 1, wherein the denier of the load-carrying and the binder filaments is within the range between 1 and 20 dtex.

4. The spunbonded web of claim 1, wherein the proportion of binder filament is between 5 and 25 percent by weight.

5. The spunbonded web of claim 1, wherein the denier of the binder filaments is less than that of the load-carrying filaments.

6. The spunbonded web of claim 1, wherein the load-carrying filaments are made of polyethylene terephthalate.

7. The spunbonded web of claim 1, wherein the melting point of the binder filaments is less than 20° C. below the melting point of the load-carrying filaments.

8. The spunbonded web of claim 1, wherein the melting point of the binder filaments is from 10 to 20° C. below the melting point of the load-carrying filaments.

9. The spunbonded web of claim 1, wherein the binder filaments are made of polyester which has been modified with isophthalic acid and which accordingly has a lowered melting point.

10. The spunbonded web of claim 1, wherein the load-carrying filaments and the binder filaments are made of flame-resistant polyesters.

11. The spunbonded web of claim 1, wherein the binder filaments contain an antistat, in particular carbon black.

12. The spunbonded web of claim 1, having a layer structure of load-carrying filaments and binder filaments.

13. The spunbonded web of claim 12, wherein the layer structure has two outer layers which do not contain any binder filaments.

14. A process for producing the spunbonded web of claim 1 by depositing load-carrying polyester filaments and binder polyester filaments from a plurality of depositor elements to form a random web in a conventional manner, comprising the step of depositing binder filaments whose melting point is less than 30° C. below the melting point of the load-carrying filaments.

15. The process of claim 14, wherein the filaments are deposited using a rotating impingement plate and a downstream guide surface.

16. The process of claim 14, wherein the filaments are deposited from a plurality of successive—viewed in the direction of movement of the web transport means—rows of depositor elements.

17. The process of claim 14, wherein the polymers for the load-carrying filaments and the binder filaments are spun and deposited in the stated weight ratio as bicomponent filaments.

18. The process of claim 14, wherein the web is consolidated by heat treatment at a temperature between the melting points of the load-carrying filaments and the binder filaments.

* * * * *